US005855536A

United States Patent [19]

Wilkinson

[11] Patent Number: 5,855,536

[45] Date of Patent: Jan. 5, 1999

[54] AEROBIC EXERCISE/HOUSEHOLD STEP

[76] Inventor: William T. Wilkinson, P. O. Box 73, Salem, N.J. 08079

[21] Appl. No.: 944,039

[22] Filed: Sep. 29, 1997

[51] Int. Cl.[6] ..... A63B 22/00

[52] U.S. Cl. ..... 482/52; 482/51; 297/423.41

[58] Field of Search ..... 482/51, 52; 297/423.41, 297/188.1; 108/130–135, 126, 129; D6/336, 350, 349; 248/188.2

[56] References Cited

U.S. PATENT DOCUMENTS

| | | | |
|---|---|---|---|
| D. 339,179 | 9/1993 | Wilkinson | D6/350 |
| D. 347,527 | 6/1994 | Breen et al. | D6/336 |
| D. 354,210 | 1/1995 | Dickinson et al. | D6/336 |
| D. 362,125 | 9/1995 | Crust | D6/350 |
| 2,566,498 | 9/1951 | Revercomb | 297/423.46 |
| 5,094,505 | 3/1992 | Nichols | 297/423.41 |
| 5,127,647 | 7/1992 | Wilkinson | 482/52 |
| 5,540,638 | 7/1996 | Wilkinson | 482/51 |

*Primary Examiner*—Jerome W. Donnelly
*Attorney, Agent, or Firm*—Connolly & Hutz

[57] ABSTRACT

An aerobic exercise/household step comprises a base having an upper surface which is horizontal and planar to comprise a primary stepping surface. The upper surface includes a recess resulting in a lower secondary stepping surface which is also horizontal and planar. A compartment is formed under a portion of the upper surface with that portion of the upper surface being hinged to the remainder of the upper surface to provide a cover for the compartment. The step may include legs to selectively elevate the base.

10 Claims, 3 Drawing Sheets

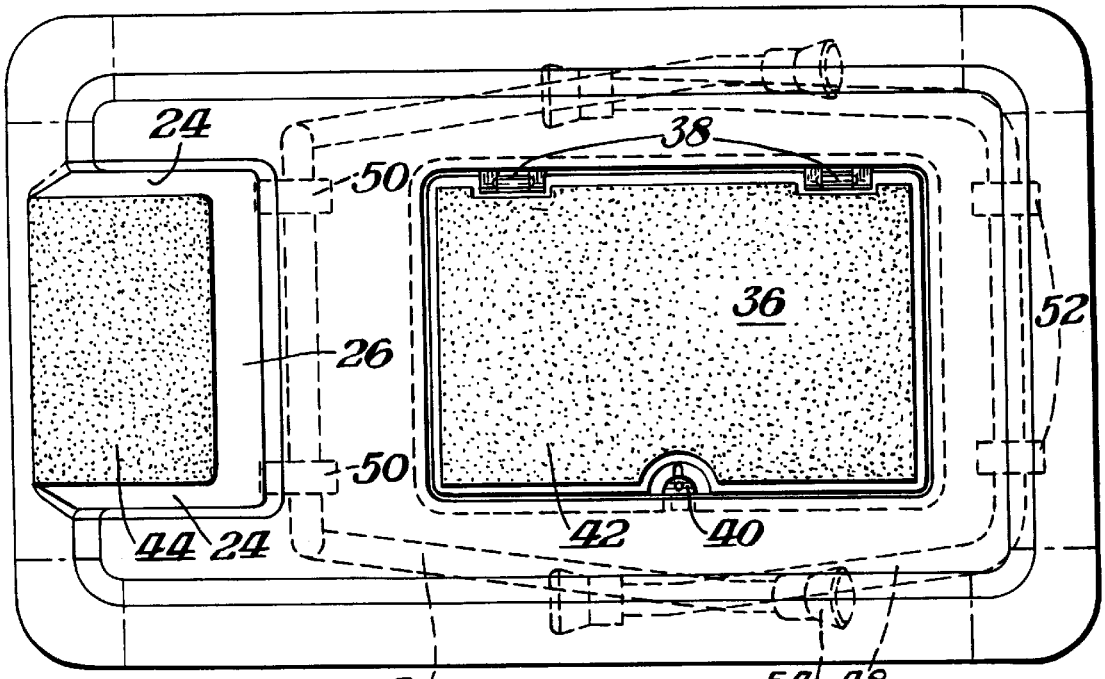
Fig.2.
Fig.1.
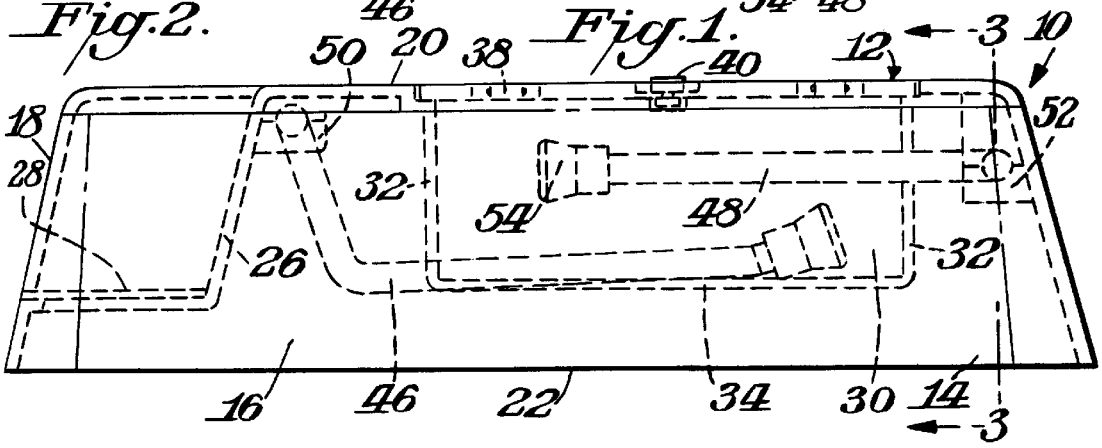
Fig.3.
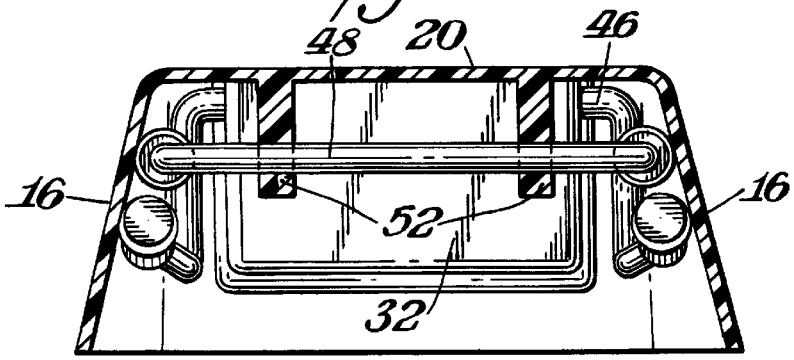

AEROBIC EXERCISE/HOUSEHOLD STEP

BACKGROUND OF THE INVENTION

Aerobic steps are known on which a user exercises. Although such exercises are sometimes done in group sessions, it is also desirable to provide a step which could be used at home for personal use. Utility or household steps or small step ladders also-are known for permitting a user to be elevated and thereby extend the range of reach of the user.

It would be desirable if a step could be provided which is capable of functioning as an aerobic exercise step or of functioning as a household or utility platform.

SUMMARY OF THE INVENTION

An object of this invention is to provide an aerobic exercise step which is also capable of being used as a household or utility platform.

A further object of this invention is to provide such a step which includes multiple height stepping surfaces.

In accordance with this invention an aerobic exercise/household step comprises a base having an upper surface with a downwardly extending apron which terminates in a lower edge. A portion of the upper surface is horizontal and planar to comprise a primary stepping surface. A further portion of the upper surface is recessed to provide a secondary stepping surface. The base also includes a storage compartment located below the upper surface.

In a preferred embodiment of this invention the compartment is located below a part of the primary stepping surface with that part of the primary stepping surface being hinged to provide a cover for the compartment.

The base may also be provided with hinged legs to selectively elevate the base so that the base could be disposed at different heights. One height would be when the base is directly on the floor at which time the legs would be stored within the apron and another height would be when the legs are extended into contact with the floor.

THE DRAWINGS

FIG. 1 is a side elevational view of an aerobic exercise/household step in accordance with this invention;

FIG. 2 is a top plan view of the step shown in FIG. 1;

FIG. 3 is a cross-sectional view taken through FIG. 1 along the line 3—3;

DETAILED DESCRIPTION

Figure 5:
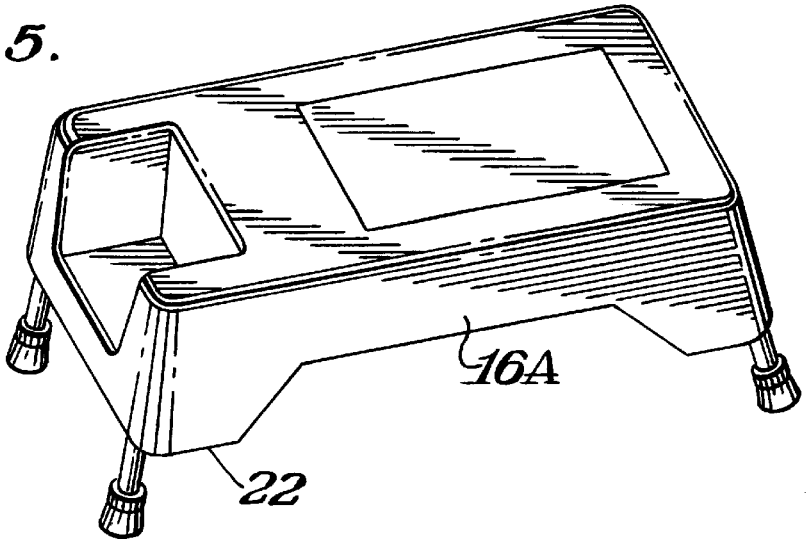
FIG. 5 is a perspective view of a modified form of step in accordance with this invention.
Figure 6:
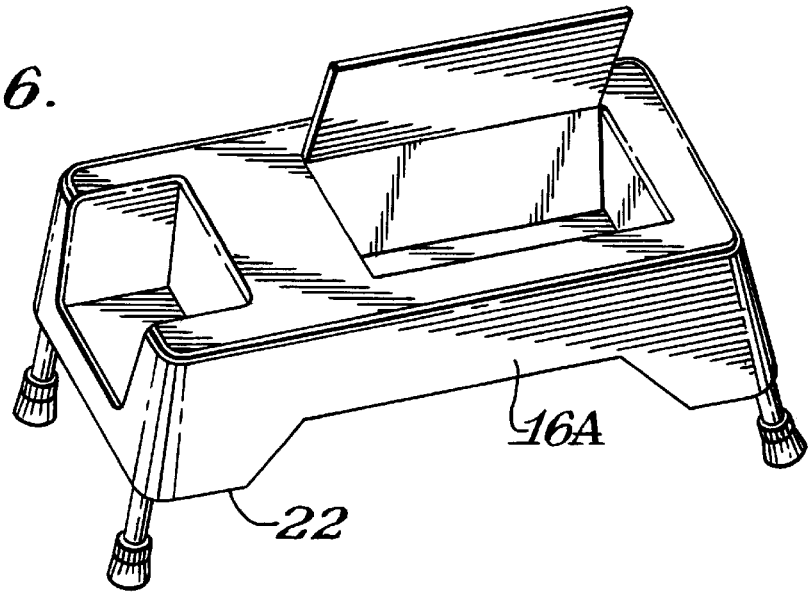
FIG. 6 is a view similar to FIG. 5 showing the compartment cover in an open condition.
Figure 7:
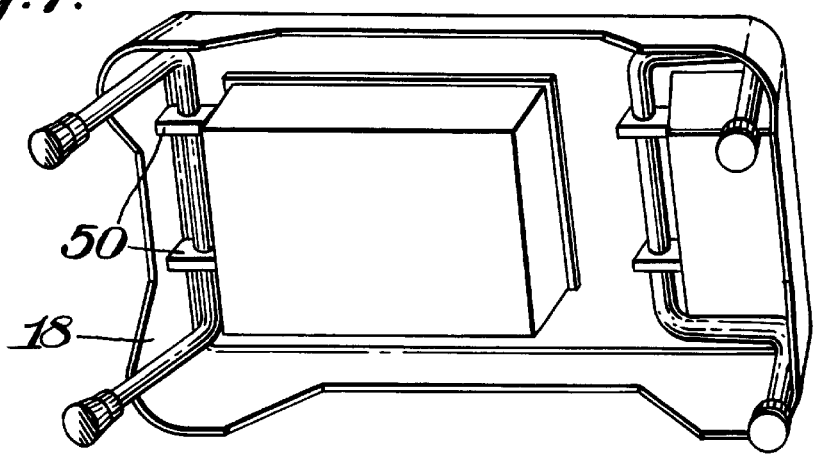
FIG. 7 is a perspective bottom view of the step shown in FIGS. 5–6.

The present invention relates to a step which may be selectively used as an aerobic exercise step or as a household or utility step. FIGS. 1–4 illustrate a first preferred embodiment of the invention, while FIGS. 5–7 illustrate an alternative preferred embodiment of the invention which has general similarities to the embodiment of FIGS. 1–4. The differences include having indented side walls in the embodiment of FIGS. 5–7 and having angled legs in the embodiment of FIGS. 5–7.

As shown in FIGS. 1–4 the step 10 comprises a base 12 having a downwardly extending apron which has elongated side walls 16 and shorter end walls 18 corresponding to the side edges and end edges of the upper surface 20 of base 12. Apron 14 terminates in a lower edge 22 which preferably is horizontal and planar so that the lower edge may rest directly on a support surface such as the floor.

Although the apron 14 is illustrated as having inclined walls 16,18 the walls may be straight or at other inclinations including being slightly inclined inwardly. Similarly, although FIGS. 1–4 illustrate the side walls 16 to extend completely across without any cut-outs, FIGS. 5–7 illustrate the side walls 16A to include indented portions. The lower edge 22 in FIGS. 5–7 would still make the base capable of being placed directly on the floor in the lowest height elevation of the step.

As illustrated the upper surface 20 of base 12 is horizontal and planar over a major portion of its area to comprise a primary stepping surface. A portion of upper surface 20, however, is indented resulting in apron 14 having indented side walls 24,24 and end wall 26 which terminate in a lower or secondary horizontal planar surface 28. Surface 28 thus comprises a helper step which could be used as a supplement to various types of aerobic exercises or which could be used as a stepping aid for the user stepping from the ground then on surface 28 and then on upper surface 20 where the step 10 is used as a utility or household step. While the figures illustrate various proportions for the upper surface 20 and secondary surface 28, the invention may be practiced with other proportions. Thus, for example, the surface 28 may be of larger size to facilitate its use as part of an aerobic training program or to act as a seat. Advantageously where step 10 is used as a household step, platform 28 may also be used as a support surface to hold items below the level of the main stepping surface 20 so that the user will not accidentally kick or step on such items.

To facilitate the use of step 10 as a household step, a compartment 30 is provided within apron 14. Preferably, compartment 30 is formed by having depending walls 32 extend downwardly from the lower surface of platform 20 with depending side walls 32 joined together by a bottom wall 34. A portion 36 of upper platform 20 is provided with hinges 38 so that the portion 36 acts as a cover to selectively open and close compartment or bin 30. Hinges 38 are recessed or located no higher than upper surface platform 20, so as not to create any obstacle or safety hazard during use of step 10. A latch 40 of any suitable construction may also be provided to selectively lock or close compartment 30. Compartment 30 may have various types of uses. For example, compartment 30 may be used to store household items such as cleaning materials when step 10 is used as a utility step. Compartment 30 may also be used to store garments or other equipment used for exercise purposes.

A non-slip surface 42 may be provided on cover 36 or on the entire upper platform 20. In addition, a non-slip surface 44 may be provided on secondary stepping surface 28.

In order to provide height adjustability to step 10, a set of legs 46,48 are provided. Legs 46,48 are preferably hinged to base 12 so that the legs can be stored within apron 14 in the non-use condition. For example, FIGS. 1–3 illustrate leg 46 to be hinged to brackets 50 mounted to the lower surface of platform 20 and to wall 26 of the recess. Leg 48 in turn is hinged to brackets 52 mounted to end wall 18 and the lower surface of platform 20. FIG. 7 illustrates a variation wherein the brackets 50A extend completely across the space between wall 32 of compartment 30 and apron end wall 18.

Figure 4:
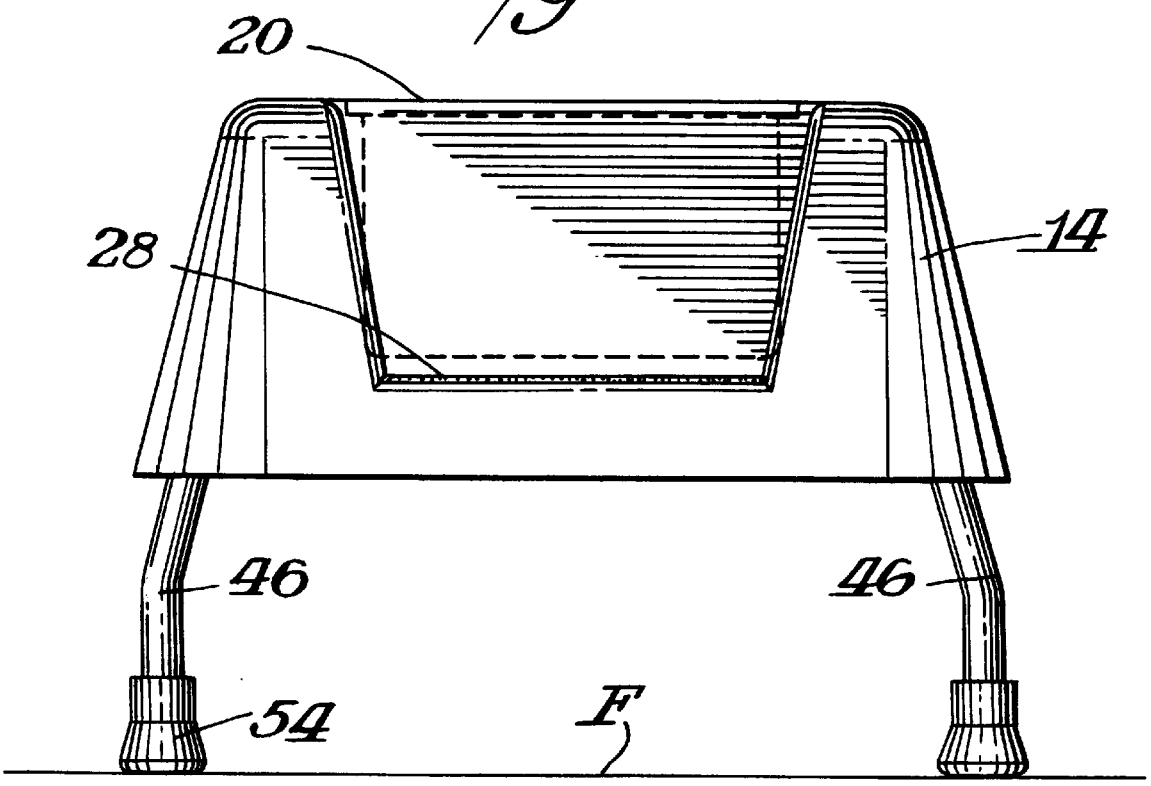
FIG. 4 is an end elevational view of the step shown in FIGS. 1–3.

When in the active condition shown in FIG. 4 the legs 46,48 extend downwardly for direct contact with the floor F. As illustrated in FIG. 4 the legs generally follow the taper of apron 14 and then bend to be vertically oriented when touching the floor. FIGS. 5–6 illustrate a variation where the legs are not bent vertically but continue outwardly along the same taper as apron 14. Each leg may be provided with a non-slip cap 54.

Step 10 may be made of any suitable dimensions. For example, walls 16,16 may have a length of 26 inches at the lower edge 22 and a length of 25 inches at their upper edges. Base 12 may be 8 inches high and 15 inches wide at its upper edge. Compartment 30 may be 13 inches long, 9 inches wide and 5 inches deep. Secondary step 28 may be 6 inches below upper platform 20 so that platform 20 is 8 inches high when lower edge 22 is on the floor and 14 inches high when legs 46,48 are extended with secondary platform 28 being 8 inches high in the leg extended condition.

The parts of step 10 may be made of a suitable plastic material. The non-slip surfaces and caps may be made of rubber and other known non-slip materials.

It is to be understood that the various dimensions, materials, shapes and proportions disclosed herein are merely for exemplary purposes.

What is Claimed is:

1. An aerobic exercise/household step comprising a base having an upper exposed surface with a downwardly extending apron and terminating in a lower edge, a portion of said upper surface being horizontal and planar to comprise a primary stepping surface, a further portion of said upper surface being recessed to provide a secondary surface extending to one of the walls of said apron, said secondary surface being horizontal and planar and disposed lower than said primary stepping surface to provide a secondary stepping surface, said base having a storage compartment below said upper surface, legs mounted to said base for raising the height of said stepping surface, said storage compartment being spaced inwardly of said apron to provide an open space, and said legs being selectively movable to a storage condition in said open space between said compartment and said apron.

2. The step of claim 1 wherein said compartment is located below a part of said primary stepping surface, said part of said primary stepping surface being hinged to a further part of said primary stepping surface to provide a cover for selectively opening and closing said compartment.

3. The step of claim 2 wherein said cover is hinged by hinges which extend no higher than said primary stepping surface.

4. The step of claim 1 wherein said legs are hinged to said base.

5. The step of claim 4 wherein said legs straddle said compartment during conditions of non-use.

6. The step of claim 5 wherein said apron is formed by a pair of elongated side walls interconnected by end walls which are shorter than said side walls, and said secondary stepping surface being located at one of said end walls.

7. The step of claim 6 wherein said secondary stepping surface is located inwardly of each of said elongated side walls whereby said recess is defined by three depending walls extending downwardly from said upper stepping surface to said secondary stepping surface.

8. The step of claim 7 wherein said legs are hinged to said base by means of mounting brackets depending from said upper primary stepping surface, and said mounting brackets being said mounting structure.

9. The step of claim 1 wherein said apron is formed by a pair of elongated side walls interconnected by end walls which are shorter than said side walls, and said secondary stepping surface being located at one of said end walls.

10. The step of claim 9 wherein said secondary stepping surface is located inwardly of each of said elongated side walls whereby said recess is defined by three depending walls extending downwardly from said upper stepping surface to said secondary stepping surface.

* * * * *